US011092159B2

(12) United States Patent
Pawellek et al.

(10) Patent No.: US 11,092,159 B2
(45) Date of Patent: Aug. 17, 2021

(54) COOLANT PUMP HAVING A USE-OPTIMISED STRUCTURE AND IMPROVED THERMAL EFFICIENCY

(71) Applicant: NIDEC GPM GmbH, Auengrund Ot Merbelsrod (DE)

(72) Inventors: Franz Pawellek, Lautertal (DE); Conrad Nickel, Troistedt (DE); Jens Hoffmann, Schwarzbach (DE); Robin Büsch, Römhild (DE); Silvio Werner, Sülzfeld (DE); Jakob Schnitzer, Hildburghausen (DE); Paul Ludwig, Erfurt (DE)

(73) Assignee: NIDEC GPM GmbH, Auengrund OT Merbelsrod (DE)

( * ) Notice: Subject to any disclaimer, the term of this patent is extended or adjusted under 35 U.S.C. 154(b) by 0 days.

(21) Appl. No.: 16/765,260

(22) PCT Filed: Oct. 25, 2018

(86) PCT No.: PCT/EP2018/079281
§ 371 (c)(1),
(2) Date: Aug. 10, 2020

(87) PCT Pub. No.: WO2019/101471
PCT Pub. Date: May 31, 2019

(65) Prior Publication Data

US 2021/0164473 A1 Jun. 3, 2021

(30) Foreign Application Priority Data

Nov. 22, 2017 (DE) ..... 102017127574.6

(51) Int. Cl.
*F04D 13/06* (2006.01)
*F04D 29/18* (2006.01)
(Continued)

(52) U.S. Cl.
CPC ..... *F04D 13/06* (2013.01); *F01P 5/10* (2013.01); *F04D 13/0633* (2013.01);
(Continued)

(58) Field of Classification Search
CPC ..... F04D 13/0673; F04D 13/064; F04D 29/5806; F04D 13/06; F04D 13/0633;
(Continued)

(56) References Cited

U.S. PATENT DOCUMENTS 3,520,642 A * 7/1970 Fulton ..... F04D 13/0633 417/420
3,933,416 A * 1/1976 Donelian ..... F04D 29/057 417/354
(Continued)

FOREIGN PATENT DOCUMENTS

CN 203896086 U 10/2014
DE 102013012143 A1 1/2015
(Continued)

OTHER PUBLICATIONS

European Patent Office, ISA/EP, International Search Report issued in PCT Application No. PCT/EP2018/079281, dated Feb. 1, 2019, 4 pages.
(Continued)

*Primary Examiner* — Dominick L Plakkoottam
(74) *Attorney, Agent, or Firm* — Wood Herron & Evans LLP

(57) ABSTRACT

In an electrical coolant pump, preferably for use as an additional water pump in a vehicle, a radial bearing of the shaft is provided by means of a radial slide bearing lubricated with coolant on the separating element which is disposed between the pump impeller and the rotor. A dry-running electric motor has a radially inner stator and a radially outer rotor is accommodated within the motor
(Continued)

chamber. A shaft seal is disposed between the radial slide bearing and the motor chamber. The rotor is formed in a cup shape, the inner surface of which faces the shaft seal and is fixed to the shaft in an axially overlapping manner. The motor chamber has an opening to the atmosphere which is closed by a liquid-tight and vapor-permeable pressure equalizing membrane. The separating element is configured as a support flange with a separating portion and an axial projection into the motor chamber, to which the stator is attached. The control unit is disposed between the separating element and the stator in the axial direction.

14 Claims, 1 Drawing Sheet

(51) Int. Cl.

| | |
|---|---|
| ***F04D 29/10*** | (2006.01) |
| ***F04D 29/06*** | (2006.01) |
| ***F04D 29/046*** | (2006.01) |
| ***F04D 29/043*** | (2006.01) |
| ***F01P 5/10*** | (2006.01) |

(52) U.S. Cl.
CPC ..... *F04D 13/0673* (2013.01); *F04D 13/0686* (2013.01); *F04D 29/043* (2013.01); *F04D 29/046* (2013.01); *F04D 29/061* (2013.01); *F04D 29/106* (2013.01); *F04D 29/18* (2013.01)

(58) Field of Classification Search
CPC ..... F04D 1/00; F04D 29/426; F04D 13/027; F04D 13/0606; F04D 25/06; F04D 25/062; F04D 25/0626; F04D 25/082; F04D 29/026; F04D 29/046; F04D 29/057; F04D 29/061; F04D 29/106; F04D 29/20; F04D 29/22; F04D 29/2216; F04D 29/2222; F04D 29/528; F04D 29/624; F04D 29/708; F01P 5/10; F01P 2005/125; F01P 3/20; F01P 5/12; H02K 1/2786
See application file for complete search history.

(56) References Cited

U.S. PATENT DOCUMENTS

| | | | | |
|---|---|---|---|---|
| 4,836,147 | A * | 6/1989 | Morris | F04D 13/0673 123/41.44 |
| 5,478,222 | A * | 12/1995 | Heidelberg | F04D 7/06 417/414 |
| 7,766,613 | B2 * | 8/2010 | Fukuki | F04D 13/0673 415/199.2 |
| 9,893,587 | B2 * | 2/2018 | Shi | F04D 13/0633 |
| 10,584,705 | B2 * | 3/2020 | Niu | F04D 29/2222 |
| 2004/0234389 | A1 * | 11/2004 | Hatano | F04D 13/0606 417/370 |
| 2004/0234395 | A1 * | 11/2004 | Hatano | F04D 13/064 417/420 |
| 2007/0090704 | A1 * | 4/2007 | Chen | H02K 1/2786 310/86 |
| 2008/0118380 | A1 * | 5/2008 | Nakanishi | F04D 29/5813 417/423.1 |
| 2017/0299063 | A1 * | 10/2017 | Itadani | F16C 17/02 |
| 2018/0238348 | A1 | 8/2018 | Pawellek et al. | |
| 2019/0353166 | A1 * | 11/2019 | Heitzig | F04D 29/528 |

FOREIGN PATENT DOCUMENTS

| | | | |
|---|---|---|---|
| DE | 102015114783 | B3 | 9/2016 |
| WO | 2015011268 | A1 | 1/2015 |

OTHER PUBLICATIONS

German Patent and Trademark Office, Office Action issued in DE 102017127574.6, dated Oct. 12, 2018, 5 pages (no English translation).

* cited by examiner

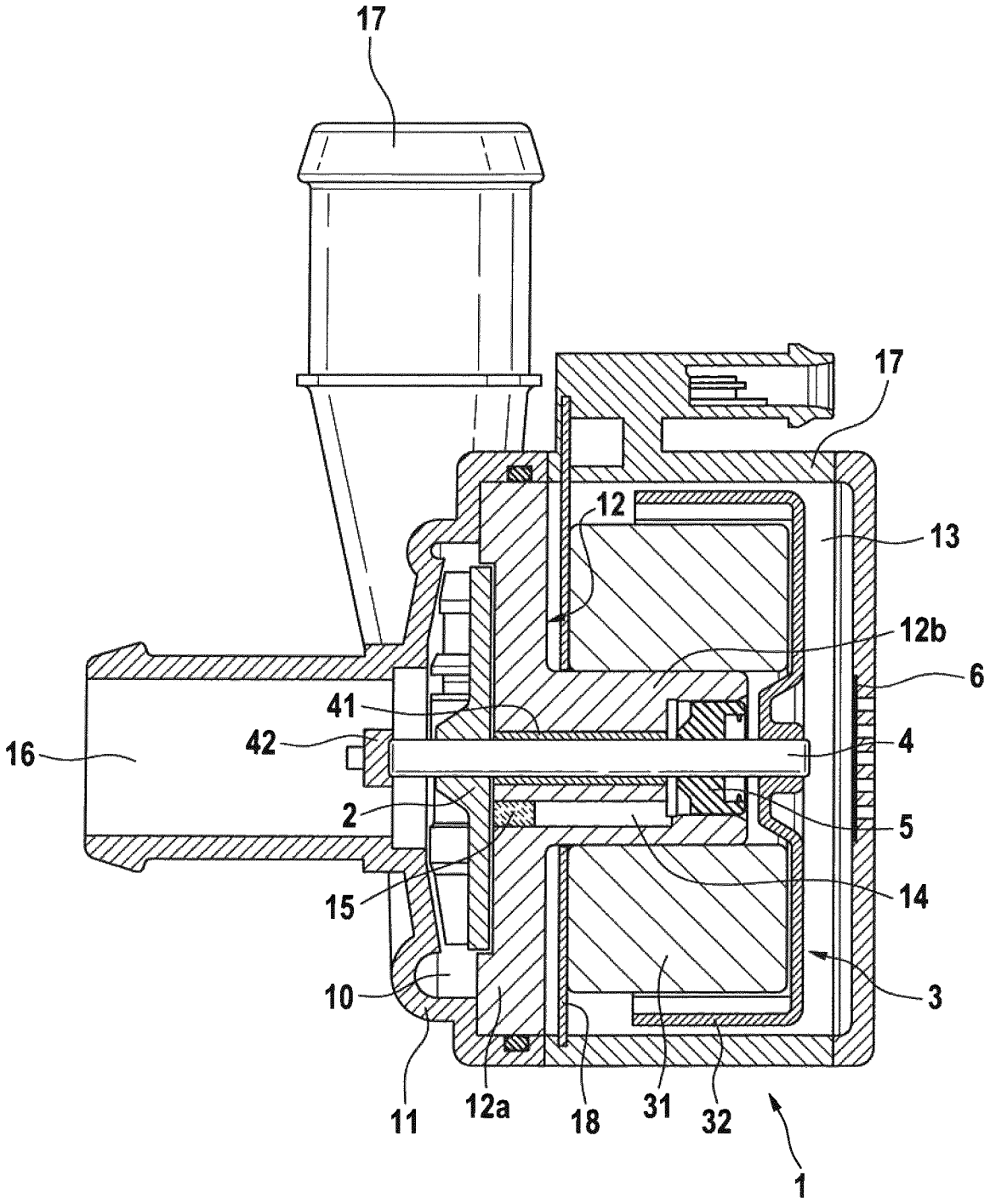
17
17
12
13
12b
6
41
42
16
4
2
5
15
14
10
3
11
12a
18
31
32
1

COOLANT PUMP HAVING A USE-OPTIMISED STRUCTURE AND IMPROVED THERMAL EFFICIENCY

CROSS-REFERENCE TO RELATED APPLICATIONS

This application is a national stage application under 35 U.S.C. § 371 of International Application No. PCT/EP2018/079281, filed on Oct. 25, 2018, which claims priority to German Application No. DE 102017127574.6, filed Nov. 22, 2017, the disclosures of which are hereby incorporated by reference herein in their entireties.

TECHNICAL FIELD

The present invention relates to an electrical coolant pump, the structure of which arising from a combination of a bearing, seal and electric motor is optimized in relation to cost, installation space and service life in the field of application of an additional water pump, and which has improved thermal efficiency and simplified contacting or wiring between the individual electrical components of the coolant pump.

BACKGROUND

Such electrical additional water pumps are used for the circulation of partial regions of a coolant-conveying thermal management system of a vehicle which is equipped with an internal combustion engine and a main water pump in order to more flexibly cool so-called hotspots on components of auxiliary devices, such as on an exhaust gas recirculation system, on a turbocharger, on a charge air cooling system or the like. The redundancy with respect to the main water pump and the increased number of lines and nodal points means that such additional water pumps of the type in question face significant pricing pressure as well as considerable demands for a compact design with small dimensions for integration in a complex package of modern thermal management systems.

By reason, inter alia, of the simpler sealing in the relatively small pump structure, wet runner electric motors of the inner runner type are used in hitherto established products of electrical additional water pumps. The use of wet runner electric motors, on which typically the stator is dry-encapsulated with respect to the rotor by a can or the like and the rotor and a bearing are designed for operation in the medium to be conveyed, represents a known measure for overcoming the problem of a leakage on a shaft seal and a defect of a shaft bearing.

However, wet runners have a lower level of efficiency because the gap between the stator and the rotor for accommodating a can turns out to be larger and a field strength acting upon the rotor is consequently attenuated. Moreover, liquid friction occurs on the rotor, whereby the level of efficiency decreases further specifically in the case of the relatively small-dimensioned pump drives of additional water pumps. Furthermore, wet runners encounter problems at low temperatures, such as icing in the gap between the stator and the rotor.

By reason of the improved level of efficiency, dry runner electric motors are also used on larger pumps, such as the electrical main water pumps. In order to mount pump shafts which are driven by a dry runner electric motor, rolling body bearings, such as e.g. ball bearings are predominately used, said bearings absorbing both axial and radial loadings and achieving low friction coefficients.

However, rolling body bearings in general are sensitive to the ingress of moisture because the materials used, in particular suitable steels of rolling bodies, are not sufficiently corrosion-resistant for use in moisture. The occurrence of moisture leads, by reason of corrosion, to the reduction in the surface quality of the rolling bodies and races, which results in greater friction of the bearing and corresponding heat development and further subsequent damage on bearings and seals. As a consequence, the already cost-intensive rolling body bearings in pumps must be provided on both end faces with, once again, cost-intensive seals which ensure low-friction and reliable sealing with respect to the occurring working pressures in the pump chamber.

In addition to the cost disadvantage, corresponding seals always cause small leakages and often constitute the limiting factor for the service life of a pump because they are subjected, per se, to frictional wear and embrittlement as a result of pressure and temperature fluctuations.

Patent application DE 10 2015 114 783 B3 by the same applicant discloses an electrical coolant pump which is designed for use as a main water pump and in which the pump shaft is mounted by a single so-called water pump bearing having two rolling body rows between the pump impeller and the electric motor. In order to overcome the problem of the ingress of leakage into the bearing and to electronic components, located downstream, of a dry runner electric motor, a leakage chamber is provided in the pump housing between a shaft seal and the water pump bearing in which chamber a leakage can be collected and discharged without coming into contact with the water pump bearing. A leakage seal located downstream thereof prevents, in turn, a collected leakage, which is to be discharged, from entering into a housing portion in which the motor components and electronics are accommodated. If a leakage from the leakage space passed directly into the housing portion of the motor, the operating temperature of the motor would cause water vapor to pass from the housing portion in the opposite direction on the unsealed, unprotected side of the water pump bearing into the bearing and permanently destroy said bearing.

The provision of such a leakage space between the pump chamber and drive gives rise to the disadvantage of the additional installation space which increases the axial dimensioning of the pump structure.

Furthermore, the use and mounting of the shaft seal and the leakage seal are associated with costs which would not be acceptable for products of an additional water pump. Furthermore, in order to minimize the risk that the water pump bearing becomes damaged by the ingress of water vapor, the use and mounting of a further bearing seal on the unprotected side of the water pump bearing would be necessary.

Moreover, arising from an application not of the type in question, a circulating pump for heating installations is known from patent application WO 2015/011268 A1, said pump being driven, again, by a wet runner electric motor. The pump shaft is mounted by a radial slide bearing and an axial bearing disposed downstream thereof and having a shaft seal. The slide bearing is lubricated with the medium to be conveyed by means of a supply within the pump shaft. A rotor space adjoining axially downstream thereof is separated by a membrane having a static sealing function with respect to an accommodation space of the stator.

The problem of the leakage at the shaft seal is not discussed in the disclosure. However, a critical situation referred to is when the membrane becomes looped through, which leads to the ingress of liquid into the electrical portion of the accommodation space and is to be avoided by a filter in the supply of lubricant.

Moreover, in the case of conventional electrical coolant pumps, operating states can occur in which heat-generating elements, such as a control unit or circuit board or the stator of the electric motor, are not sufficiently cooled and the wiring between the control unit or the electronics and the electric motor is frequently difficult to implement and it is susceptible to damage by dynamic loading by reason of the positions in which these elements are disposed.

For instance, JP 2017-110 593 A discloses an electrical coolant pump in which the circuit board and the stator are disposed on axially opposed sides of a motor chamber. As a result, the wiring of these elements is difficult to implement and it is susceptible to damage by dynamic loading during operation by reason of the spatial distance. Moreover, the arrangement of the stator in an almost encapsulated manner between a housing portion and a rotor on the one hand and a pair of magnets and a further rotor on the other hand makes it more difficult for heat to be discharged therefrom.

DE 10 2015 213 201 A1 also describes a coolant pump in which the dissipation of heat from the stator may be insufficient by reason of its arrangement in the motor chamber on the pump housing because the pump housing, in the case of a sealed package in the installation space of the coolant pump, can be heated by ancillary units and therefore the discharge of heat from the stator may be insufficient.

SUMMARY OF THE INVENTION

Based upon the problems of the prior art which has been discussed, an object of the invention is that of providing a simple, cost-effective and compact pump structure for a dry runner electric motor.

A further aspect of the invention is that of providing a pump structure in which a leakage space between a shaft seal and the dry runner electric motor can be omitted in favor of a shorter axial structure of the pump.

A further aspect of the invention is that of providing a cost-effective and long-lasting alternative in relation to the mounting and sealing of a shaft.

A further aspect of the invention is that of providing improved cooling of the control unit and of the stator.

A further aspect of the invention is that of providing simple and robust contacting or wiring between the control unit and the stator.

In accordance with the invention, the objects are achieved by an electrical coolant pump according to claim 1.

The electrical coolant pump is characterized in particular by virtue of the fact that a radial bearing of the shaft is provided by means of a radial slide bearing lubricated with coolant on a separating element between a pump chamber and a motor chamber within the pump housing formed by a motor housing, which is disposed between the pump impeller and a rotor of a dry-running electric motor; the electric motor having a radially inner stator and a radially outer rotor is accommodated within the motor chamber; a shaft seal is disposed between the radial slide bearing and the motor chamber; the rotor is formed in a cup shape, the inner surface of which faces the shaft seal and is fixed to the shaft in an axially overlapping manner; the motor chamber has an opening to the atmosphere which is closed by a liquid-tight and vapor-permeable pressure equalizing membrane; the separating element is configured as a support flange with a separating portion and an axial projection into the motor chamber, to which the stator is attached; and the control unit is disposed between the separating element and the stator in the axial direction.

The invention in its most general form is based upon the knowledge that by reason of the inventive selection, combination and arrangement of the individual components of the pump, a complementary functional chain consisting of a pressure reduction to limit a leakage at a shaft seal, optimum vaporization of a leakage and discharge of a vaporized leakage is achieved, whilst exploiting operating conditions in the pump, as is effective heat dissipation from the control unit or circuit board and the stator via the separating element to medium to be conveyed, thereby also providing economic and design-related advantages corresponding to the objects.

The invention firstly makes provision to provide, for a dry runner electric motor, a pressure-reduced region for a shaft seal upstream of a medium to be conveyed, said region being formed axially downstream of a slide bearing lubricated by the medium to be conveyed. By virtue of a lower pressure of the medium to be conveyed in comparison with a corresponding sealing surface within the pump chamber, a leakage which passes through at the shaft seal turns out to be smaller.

Furthermore, the invention firstly makes provision to use, downstream of the shaft seal, a dry runner electric motor of the outer runner type having a cup-shaped rotor, of which the preferably closed inner surface faces the shaft seal. Therefore, liquid drops of a leakage downstream of the shaft seal are guided by radial acceleration on the inner surface of the rotor forcibly through the air gap of the dry runner between the open field coils of the stator and the magnetic poles of the rotor before they can pass into a motor chamber containing electronics. The leakage drops are vaporized by the operating temperature of the electric motor and by a turbulent swirling movement in the air gap. Only then does the water vapor produced pass into the motor chamber and escape into the atmosphere through a membrane. As a result, it is possible to dispense with any encapsulation of the stator and to avoid the associated disadvantages of the level of efficiency of an electric motor of the wet runner type.

Furthermore, by using a dry runner an alternative is provided to the use of cost-intensive rolling body bearings and a seal on both sides thereof.

This eliminates the disadvantage of a limited service life of each bearing seal which always applies even to expensive types of seals and so a longer service life of the additional water pump is to be expected without any defect to the shaft bearing.

At the same time, by omitting shaft seals and motor seals or a separating can, a pump structure having fewer components and favorable slide bearings is provided in accordance with the invention.

Finally, in accordance with the invention a compact pump structure with small axial dimensioning is achieved in which, despite the omission of a leakage space, a permanently secure operating environment is provided for a dry runner in the pump housing.

Furthermore, the invention firstly makes provision to dispose a stator in contact with a support flange which serves as a separating element between the pump chamber and motor chamber, and to dispose the control unit or circuit board in the axial direction between the separating element and the stator, whereby the stator and the control unit can be effectively cooled by means of heat dissipation via the separating element to the medium to be conveyed. Moreover, by reason of the spatial proximity between the control unit and the stator, the contacting or wiring between the control unit and the stator is simplified and a robust wired connection can be provided.

Advantageous developments of the additional water pump are provided in the dependent claims.

According to one aspect of the invention, a filling material is introduced between the control unit and the separating element as a gap filler.

As a result, the thermal resistance between the control unit and the separating element can be reduced by the air gap present between these elements and the heat dissipation from the stator and the control element via the separating element to the medium to be conveyed can thus be performed even more effectively because the filling material has a higher thermal conductivity than air.

According to one aspect of the invention, the separating element is accommodated at least partially within a pump cover of the pump housing in the axial direction.

As a consequence, the number of interfaces between the individual elements of the pump housing can be reduced and the sealing of the pump can thus be simplified. Moreover, the separating element can be exactly positioned in the radial direction in a simple manner.

According to one aspect of the invention, an axial bearing of the shaft can be provided by an axial slide bearing which is disposed upstream of the pump impeller in a flow direction of the coolant.

As a consequence, an axial load on the shaft is also absorbed by a slide bearing, whereby, in accordance with the object of the invention, a simple, cost-effective shaft bearing is provided which consists exclusively of two slide bearings lubricated by the coolant.

According to one aspect of the invention, the axial slide bearing can be formed by a free end of the shaft and a run-up surface on the pump housing, preferably on a pump cover.

During operation, the pump impeller generates a thrust in the direction of the intake connection or inlet of the pump. By virtue of an end-side slide surface of the shaft and a corresponding housing-side run-up surface, a particularly simple but sufficient axial bearing is provided without any necessary axial fixing in the opposite direction. As a result, the structure and assembly can be further simplified.

According to one aspect of the invention, the shaft seal can have at least two sealing lips for dynamic sealing on the shaft circumference which are aligned at least to an axial side so as to be seal-effective.

By means of a double-lipped shaft seal, favorable and sufficient leakage protection is provided downstream of the axial slide bearing, which in comparison with mechanical seals achieves considerably improved sealing and allows merely small accumulations of leakage drops to pass through. Sealing in the opposite direction, such as in the case of a pump structure having a dry rolling bearing, can be omitted by reason of the wet-running slide bearing.

According to one aspect of the invention, the separating element can have at least one lubrication channel which connects the pump chamber to a rear end of the radial slide bearing opposite from the pump chamber.

By means of one or a plurality of connections of the front and the rear axial end of the slide bearing to the pump chamber, it is possible, in order to lubricate the slide bearing, not only to apply means to be conveyed statically on one side until the bearing gap is saturated, but also to continuously circulate means to be conveyed in the bearing gap. This achieves a more uniform pressure distribution of the means to be conveyed in the bearing gap as well as removal of particles by abrasion of the bearing surfaces in favor of improved lubrication or lower friction.

According to one aspect of the invention, at least one filter can be assigned to the at least one lubrication channel.

Insofar as the configuration of the flow paths provides a circulation direction in which the medium to be conveyed flows initially through a lubrication channel and subsequently through the bearing gap, a filter in each lubrication channel or a filter for all lubrication channels prevents particulate impurities from passing into the bearing gap or to the shaft seal. By reason of the configuration and thickness of the filter, a suitable pressure drop can be adjusted which in comparison with the pump chamber results in a pressure-reduced region which relieves the shaft seal and still ensures sufficient circulation through the bearing gap.

According to one aspect of the invention, the stator of the electric motor is disposed so as to axially overlap the at least one lubrication channel.

By arranging one or in particular a plurality of radially distributed lubrication channels adjacent to the stator of the electric motor, during operation a power loss of the field coils of the stator caused by heat transfer in the pump housing is transmitted to the means to be conveyed, which circulates in the lubrication channels, and is discharged to the flow to be conveyed in the pump chamber. This advantageous effect can also be utilized even in the case of small temperature differences between a high coolant temperature and a constantly even higher temperature of the coil windings.

BRIEF DESCRIPTION OF THE DRAWING

FIG. 1 is an axial sectional view of a coolant pump according to an embodiment of the invention.

DETAILED DESCRIPTION

The invention will be explained hereinafter with the aid of an exemplified embodiment and with reference to the drawing in FIG. 1.

As can be seen in the axial sectional view in FIG. 1, a pump housing 1 comprises, on a side illustrated on the left, an intake connection 16 and a pressure connection 17 which issue into a pump chamber 10. The intake connection 16 serves as a pump inlet which is attached in the form of a separate pump cover 11 to an open axial end of the pump housing 10 and leads to an end side of a pump impeller 2 which is fixed on a shaft 4. The circumference of the pump chamber 10 is surrounded by a spiral housing which transitions tangentially to a pressure connection 17 which forms a pump outlet.

The pump impeller 2 is a known radial pump impeller having a central opening adjoining the intake connection. The flow to be conveyed which flows towards the pump impeller 2 through the intake connection 16 is accelerated and diverted by the inner blades radially outwards into the spiral housing of the pump chamber 10.

On a side illustrated on the right, the pump housing 1 comprises a hollow space which is designated as a motor chamber 13 and is separated from the pump chamber 10 by a separating element 12 configured as a support flange 12.

The support flange 12 is produced from a material having a high thermal conductivity, such as e.g. metal, in order to permit effective heat transfer between the motor chamber 13 and the pump chamber 10 or permit effective heat dissipation from the motor chamber 13 to the medium to be conveyed in the pump chamber 10. In the case of the exemplified embodiment shown in FIG. 1, the support flange 12 is produced from an aluminum alloy. The support flange 12 has a separating portion 12*a*, which provides the separation between the motor chamber 13 and the pump chamber 10, and a projection or projection portion 12*b* on which the stator 31 is attached or fixed.

As shown in FIG. 1, the pump cover 11 engages around the separating portion 12*a* of the support flange 12 on an outer circumferential side of the support flange 12 and so the separating portion 12*a* of the support flange 12 is accommodated at least partially within the pump cover 11 in the axial direction. Disposed between the support flange 12 and the pump cover 11 is a sealing element, such as e.g. an O-ring, in order to prevent a leakage of the medium to be conveyed in the pump chamber 10. As shown in FIG. 1, the sealing element in the case of the present exemplified embodiment is disposed on an outer circumferential surface of the separating portion 12*a* of the support flange 12, but the sealing element can also be disposed e.g. on the side surface of the separating portion 12*a* facing the pump cover 11 in the axial direction. The above-described configuration permits simple and exact positioning of the support flange 12 in the radial direction and also a simplified structure and simplified sealing of the pump housing 1 because the entire separating portion 12*a* of the support flange 12 is located radially inside the connection portion between the pump cover 11 and the motor housing 17 and thus, in comparison with a case in which the pump cover 11 is connected to the motor housing 17 via the separating portion 12*a*, fewer housing interfaces are present.

A brushless electric motor 3 of the outer-runner type is accommodated in the motor chamber 13. A stator 31 having field coils of the electric motor 3 is fixed around the projection portion 12*a* of the support flange 12 which has e.g. a cylindrical configuration and so the stator 31 is in contact with the projection portion 12*a*. This ensures very effective heat dissipation from the stator 31 in the motor chamber 13 via the support flange 12 to the medium to be conveyed in the pump chamber 10. A rotor 32 having permanently magnetic rotor poles is fixed on the shaft 4 so as to be rotatable about the stator 31.

FIG. 1 shows that a control unit or circuit board 18 of the pump including power electronics of the electric motor 3 is disposed in the axial direction between the separating portion 12*a* of the support flange 12 and the stator 31. By reason of the spatial proximity between the circuit board 18 and the support flange 12 on the one hand and the stator 31 and the circuit board 18 on the other hand, effective heat dissipation from the circuit board 18 via the support flange 12 to the medium to be conveyed is facilitated and good prerequisites are provided for simple and robust contacting or wiring between the circuit board 18 and the electric motor 3.

Disposed in the air gap between the separating portion 12*a* and the circuit board 18 is a filling material, such as a gap filler, having a high thermal conductivity and so the heat transfer from the circuit board 18 to the medium to be conveyed in the pump chamber 10 can be further improved.

The electric motor 3 is a dry runner type, of which the field coils are exposed in a non-encapsulated or open manner with respect to the motor chamber 13 at the air gap to the rotor 32. The rotor 32 has a cup shape which is typical of an outer runner and is seated on the free end of the shaft 4 illustrated on the right and supports the permanently magnetic rotor poles in the axial region of the stator 31. However, what is not typical of a rotor body is that the rotor 32 preferably has no apertures in a radially extending portion, as is routine in a conventional manner for reducing the accelerated mass on rotating support bodies. Therefore, the cup-shaped rotor 32 has preferably a closed inner side which is open only on the left side for accommodating the stator 31.

The shaft 4 which extends between the pump chamber 10 and the motor chamber 13 is mounted in a radial manner in the support flange 12 by means of a radial slide bearing 41. The slide surfaces at the shaft circumference and at the bearing seat of the slide bearing 41 are lubricated by means of the coolant which is conveyed by the additional water pump and penetrates into the bearing gap between the slide surfaces, as described later.

Moreover, the shaft 4 is mounted in an axial manner on the left, free end. The axial slide bearing 42 is established by means of a slide surface pairing between the end face of the shaft 4 and a run-up surface which is provided positioned accordingly on the pump cover 11 by means of a projection or a strut in the intake connection 16 upstream of the pump impeller 2. During operation, the pump impeller 2 pushes the shaft 4 by means of a suction effect in the direction of the intake connection 16 against the run-up surface and so axial load absorption of the shaft bearing is sufficient in this direction. Since a bearing gap between the slide surfaces is surrounded by the flow to be conveyed, the axial slide bearing 42 is also lubricated with coolant, at least in the form of an initial wetting of the slide surfaces by the coolant and renewed wetting of said slide surfaces under vibration and turbulence.

Disposed between the radial slide bearing 41 and the motor chamber 13 is a shaft seal 5 which seals an open end of the projection portion 12*b* of the support flange 12 with respect to the shaft 4. The shaft seal 5 is a double-lipped seal which is pressed into the projection portion 12*b* of the support flange 12, and two sealing lips (not illustrated) which are located one behind the other and are directed in the direction of the radial slide bearing 41 for one-sided dynamic sealing on the shaft circumference.

Furthermore, a lubrication channel 14 is introduced in the wall of the projection portion 12*b* of the support flange 12 and issues on the one hand on a rear side of the pump impeller 2 into the pump chamber 10 and on the other hand leads to an annular hollow space which surrounds the shaft 4 between the rear end of the radial slide bearing 41 and the shaft seal 5. During operation, coolant flows from the pump chamber 10 through the lubrication channel 14 to the shaft 4 and penetrates, in a manner delimited by the shaft seal 5, into the bearing gap between the shaft circumference and the bearing seat of the radial slide bearing 41 so that it flows back in the opposite direction. The axial circulation of the coolant in combination with the rotational movement between the slide surfaces ensures uniform distribution and lubrication of the bearing gap with the coolant. The coolant contains a frost protection additive having a friction-reducing property, such as e.g. a glycol, silicate or the like. At the same time, particles arising from abrasion of the slide surface pairing are transported away to the pump chamber and into the flow to be conveyed. In the case of the exemplified embodiment in FIG. 1, only one lubrication channel 14 is provided; however, a plurality of such lubrication channels 14 can be provided in the projection portion 12*a* of the support flange 12.

On the other hand, a filter 15 is disposed in the region where the lubrication channel 14 issues to the pump chamber 10, said filter preventing particulate impurities, such as metallic abrasion or the like, from being flushed from the flow to be conveyed into the bearing gap of the radial slide bearing 41 or into the sealing gap of the shaft seal 5. If the coolant circulates through the lubrication channel 14 and the radial slide bearing 41, the annular hollow space between the radial slide bearing 41 and the shaft seal 5 is subjected to a reduced pressure in comparison with the pump chamber 10 by reason of a flow resistance of the filter 15. Although the reduced pressure, which, in addition to the configuration of the filter, is also adjusted by the number and the flow cross-section of the lubrication channel 14, attenuates the circulation through the radial bearing, it also relieves the shaft seal 5, thus resulting in a longer service life of the sealing lips by virtue of less friction and a smaller leakage.

However, the small unavoidable leakage which passes from the circulation of the lubrication channel 14 in a dropwise manner through the shaft seal 5 over the course of time does not come directly into contact with the field coils or the motor electronics in the motor chamber 13. During operation, the leakage drops pass downstream of the shaft seal 5 to the inner surface of the rotating rotor 32 and are carried radially outwards by the centrifugal force. By reason of swirling movements at the rotor poles or permanent magnets and by reason of the operating temperature resulting from the power loss at the field coils, the leakage drops vaporize in the air gap between the stator 31 and the rotor 32 without being able to exert wetting in a liquid phase, i.e. a corrosive effect, on the radially inner stator 32.

By reason of the closed cup shape of the rotor 32, the leakage drops cannot pass in the axial direction into the motor space 13 but instead are collected on the inner surface of the rotor 32 and directed to the air gap for vaporization. In order to minimize a volume of the air gap, the air gap is configured to be complementary to the circumferences of the stator 32. By reason of the arrangement of the control unit 18 between the support flange 12 and the stator 31, the control unit is protected against the leakage drops or the vaporized leakage.

The transition of leakage drops from the liquid phase to the gaseous phase is associated with a volume increase which, in the case of a closed volume of the motor chamber 13, would lead to a pressure increase, irrespective of a pressure fluctuation which would result by reason of temperature fluctuations between operation and non-operation of the pump.

However, between the motor chamber 13 and the surrounding atmosphere a membrane 6 is provided which is attached to the cup-shaped motor housing 17 in the motor chamber 13. In the case of this exemplified embodiment, the membrane 6 is adhered in a radially central portion of an inner surface of the motor housing 17 facing the rotor in the axial direction and allows the equalization of pressure fluctuations from the motor chamber 13 to the atmosphere. As a result, a cost-effective and large-area adhesive membrane can be used at a protected site. The motor housing 17 has in this region a permeable or open-pored structure which is configured such that the membrane 6 is sufficiently protected and is not damaged during high pressure jet tests. The membrane 6 is semi-permeable in relation to water-permeability, i.e. it does not allow water in a liquid phase to pass through, whereas moisture-laden air can diffuse through up to a limit in relation to a droplet size or a droplet density agglomerating at the membrane surface. Therefore, during a volume expansion caused by vaporization in the motor chamber 13, moisture-laden warm air can pass through the membrane 6 and so vaporized leakage drops are effectively discharged into the atmosphere. In the opposite direction, the membrane 6 protects, in turn, against the ingress of splash water or the like during the drive operation of the vehicle.

Furthermore, a connector for external power supply is disposed on the top side of the pump housing 1.

In addition to the illustrated and described embodiment, the invention can also be carried out using alternative embodiments with additional features or without described features. As is apparent from the explanations relating to the achievement of the object, the pump can likewise be produced without lubrication channels 14 and filters 15 or with an axial bearing other than the slide bearing 42 in the region of the intake connection 16 or with a shaft seal 5 other than the one having two sealing lips. In one case in which no lubrication channels 14 are provided, it is at least possible to utilize static lubrication—which can be adjusted via the bearing gap—of the bearing gap of the radial slide bearing 41 by means of the operating pressure from the pump chamber 10, wherein, again, a reduced pressure in comparison with the pump chamber 10 acts upon the shaft seal 5 downstream of the radial bearing 41.

What is claimed is:

1. An electrical coolant pump for conveying coolant within a vehicle, comprising:

a pump housing having a pump chamber in which a pump impeller is rotatably located, an inlet and an outlet which are connected to the pump chamber;

a separating element between the pump chamber and a motor chamber disposed within the pump housing formed by a motor housing;

a shaft onto which the pump impeller is fixed;

a control unit disposed in the motor chamber;

wherein a radial bearing of the shaft is provided by a radial slide bearing lubricated with coolant on the separating element, which is located between the pump impeller and a radially outer rotor;

a dry-running electric motor having a radially inner stator and the radially outer rotor is located within the motor chamber;

a shaft seal is disposed between the radial slide bearing and the motor chamber;

the rotor is formed in a cup shape, an inner surface of which faces the shaft seal and is fixed to the shaft in an axially overlapping manner;

the motor chamber has an opening to the atmosphere which is closed by a liquid-tight and vapour-permeable pressure equalising membrane;

the separating element is configured as a support flange with a separating portion and an axial projection into the motor chamber, to which the stator is attached; and the control unit is disposed axially between the separating element and the stator.

2. The electrical coolant pump according to claim 1, wherein a filling material is introduced between the control unit and the separating element as a gap filler.

3. The electrical coolant pump according to claim 1, wherein the separating element is accommodated at least partially within a pump cover of the pump housing in the axial direction.

4. The electrical coolant pump according to claim 2, wherein the separating element is accommodated at least partially within a pump cover of the pump housing in the axial direction.

5. The electrical coolant pump according to claim 1, wherein an axial bearing of the shaft is provided by an axial slide bearing which is disposed upstream of the pump impeller in a flow direction of the coolant.

6. The electrical coolant pump according to claim 5, wherein the axial slide bearing is formed by a free end of the shaft and a run-up surface on the pump housing.

7. The electrical coolant pump of claim 6, wherein the pump housing includes a pump cover on which the run-up surface is located.

8. The electrical coolant pump according to claim 1, wherein an axial slide bearing is formed by a free end of the shaft and a run-up surface on the pump housing.

9. The electrical coolant pump of claim 8, wherein the pump housing includes a pump cover on which the run-up surface is located.

10. The electrical coolant pump according to claim 1, wherein the shaft seal has at least two sealing lips for dynamic sealing on the shaft circumference which are aligned to at least one axial side so as to be seal-effective.

11. The electrical coolant pump according to claim 1, wherein the separating element has at least one lubrication channel which connects the pump chamber to a rear end of the radial slide bearing opposite from the pump chamber.

12. The electrical coolant pump according to claim 11, wherein the at least one lubrication channel includes at least one filter.

13. The electrical coolant pump according to claim 11, wherein the stator of the electric motor is disposed so as to axially overlap the at least one lubrication channel.

14. The electrical coolant pump according to claim 1 as an additional water pump in a coolant-conveying system in a vehicle having an internal combustion engine and a main water pump.

* * * * *